US008839772B2

(12) United States Patent
Lee

(10) Patent No.: US 8,839,772 B2
(45) Date of Patent: Sep. 23, 2014

(54) ARCHERY QUIVER

(75) Inventor: Scott D. Lee, Au Gres, MI (US)

(73) Assignee: Grace Engineering Corp., Memphis, MI (US)

( * ) Notice: Subject to any disclaimer, the term of this patent is extended or adjusted under 35 U.S.C. 154(b) by 142 days.

(21) Appl. No.: 13/605,527

(22) Filed: Sep. 6, 2012

(65) Prior Publication Data

US 2013/0081604 A1 Apr. 4, 2013

Related U.S. Application Data

(60) Provisional application No. 61/541,646, filed on Sep. 30, 2011.

(51) Int. Cl.
*F41B 5/06* (2006.01)

(52) U.S. Cl.
CPC ..... *F41B 5/066* (2013.01); *Y10S 224/916* (2013.01)
USPC ..... 124/86; 224/916

(58) Field of Classification Search
CPC ..... F41B 5/066
USPC ..... 124/25.5, 25.7, 86, 88; 224/916; 403/109.5, 110, 322.4, 374.5
See application file for complete search history.

(56) References Cited

U.S. PATENT DOCUMENTS

| | | | | |
|---|---|---|---|---|
| 2,722,958 | A | 11/1955 | King et al. | |
| 4,020,984 | A | 5/1977 | Morris | |
| 4,195,616 | A | 4/1980 | Darlington | |
| 4,252,101 | A * | 2/1981 | Spitzke | 124/45 |
| 4,497,092 | A * | 2/1985 | Hoshino | 24/514 |
| 4,621,606 | A | 11/1986 | Toth | |
| 4,635,611 | A | 1/1987 | Priebe | |
| 4,685,438 | A | 8/1987 | Larson | |
| 4,788,961 | A * | 12/1988 | Toth | 124/25.5 |
| 5,265,585 | A | 11/1993 | Stinson | |
| 5,566,665 | A | 10/1996 | Stinson | |
| 5,911,215 | A * | 6/1999 | Fisher, Jr. | 124/86 |
| 6,006,734 | A | 12/1999 | Sodaro | |
| 6,105,566 | A | 8/2000 | Tiedemann | |
| 6,142,699 | A * | 11/2000 | Pao | 403/109.5 |
| 6,672,299 | B2 | 1/2004 | Proctor | |
| 6,948,878 | B1 * | 9/2005 | Smith et al. | 403/110 |
| 7,775,201 | B2 * | 8/2010 | Cooper | 124/86 |
| 7,987,842 | B2 * | 8/2011 | McPherson | 124/86 |
| 8,256,983 | B2 * | 9/2012 | Lin | 403/322.4 |
| 8,608,118 | B2 * | 12/2013 | Lai | 248/74.3 |
| 2010/0024793 | A1 | 2/2010 | Lorocco et al. | |

OTHER PUBLICATIONS

G5 Mag Loc 2011.

* cited by examiner

*Primary Examiner* — John Ricci
(74) *Attorney, Agent, or Firm* — Warner Norcross & Judd LLP

(57) ABSTRACT

An accessory mounting system for mounting a first object to a second object is provided. The system can be used to mount a quiver to an archery bow, or an archery or hunting accessory. The system can include a primary element having a projection that fits into an aperture defined by a secondary element. The secondary element can include a base, an engagement member and an actuator. The base can define at least a portion of an aperture. To the base, the engagement member can be moveably mounted to clampingly engage the projection when in the aperture. The actuator can be configured to actuate the engagement member, thereby fixedly mounting the secondary element to the projection. A related method of use also is provided.

20 Claims, 4 Drawing Sheets

ARCHERY QUIVER

BACKGROUND OF THE INVENTION

The present invention relates to devices that can be used to detachably mount objects in a fixed position relative to another object, and more particularly, to a quiver for an archery bow including an adjustable quick connect mounting system for detachably mounting a quiver to a structure such as a bow, a bow accessory, a belt, a tree stand, or other hunting or archery items.

In the field of archery, quivers typically are used to conveniently and safely transport and hold one or more arrows at the ready for an archer. Many quivers include a simple mounting block that mounts directly to the riser of the bow. The mounting block is screwed directly to pre-tapped holes in the riser. Conventional quivers typically include a rod that extends upwardly from the mounting block to a hood. The rod also may include another arrow holder located a distance below the hood. Arrows are locked in the arrow holder, and associated field points or broadheads of the arrows are housed in the hood.

An issue with many conventional quivers is the mounting element. Some mounting elements use a tapered slot portion mounted on the bow, and a corresponding tapered fin associated with a quiver. The fin slides into the tapered slot to join the quiver to the bow. Such constructions can be cumbersome to handle and operate. Other mounting devices are constructed from resilient elastomeric rubber elements that hinge open to receive a rail which extends from a hood to an arrow holder. These constructions can be overly stiff at first, or can become too resilient over time, thereby reducing the holding strength of the rubber elements. Yet other mounting devices utilize sets of magnets, with one magnet associated with the mounting block, and another associated with a portion of the quiver to magnetically lock the quiver to the mounting block.

While the above mounting devices are satisfactory in many circumstances, it is believed that there is room for improvement with regard to mounting devices used to mount first object to a second object, and more particularly to mount a quiver to an archery bow.

SUMMARY OF THE INVENTION

An accessory mounting system for mounting a first object to a second object is provided. In one embodiment, the mounting system is incorporated into a quiver, and can be used to mount the quiver to an archery bow, or optionally to an archery accessory, a harness, a belt, a tree stand, a backpack, a ground blind, a vehicle, or other item used in archery or bow hunting activities.

In another embodiment, the mounting system can include a primary element configured to mount directly to an archery bow or an archery accessory, such as a bow sight. The primary element can include a projection which can be of a variety of geometric configurations, for example, it can be cylindrical, triangular, square rectangular, pentagonal, hexagonal, octagonal or other configurations.

In still another embodiment, the mounting system can include a secondary element that includes a base, an engagement member, and an actuator. The base can define at least a portion of an aperture adapted to receive at least a portion of the primary element. To the base, the engagement member can be moveably mounted and configured to engage the primary element when inserted in the aperture. The actuator can be positioned adjacent the engagement member and configured to move or otherwise actuate the engagement member so that the engagement member engages the primary element and secures the secondary element to the primary element.

In yet another embodiment, the mounting system can include a retaining element that can retain the actuator in a desired configuration, thereby effectively locking the engagement member so that the secondary element fixedly and securedly joins the primary element.

In even another embodiment, the mounting system can be configured so that the secondary element is removably and detachably secured to the primary element without the use of tools, that is, in a tool-less operation, a user can manually adjust the actuator to disengage the secondary element from the primary element. Alternatively, the user can adjust the actuator to engage the primary element with the secondary element to lockingly engage these elements in a fixed and immovable configuration relative to one another.

In a further embodiment, the secondary element can be operable in an open mode and a closed mode. In the open mode, the engagement member can be oriented in an open position so that the primary element, and specifically the projection, can be positioned at least partially within the aperture defined by the secondary element. In the closed mode, an actuator can move the engagement member to engage the primary element and lock the secondary element in a fixed spatial orientation relative to the primary element. For example, the primary element cannot slide, rotate or otherwise move relative to the secondary element. Optionally, the engagement member clampingly engages a periphery of the primary element or otherwise traps the primary element projection between the engagement member and another portion of the base of the secondary element.

In still a further embodiment, the secondary element is joined with one or more supporting structures that join the secondary element with a quiver hood and one or more optional arrow holders. The supporting structures can be in the form of rods that extend away from the base of the secondary element, and can be joined at a distal end of the rods to a quiver. The supporting structures also can extend in a second direction away from the secondary element, generally below the attachment point or region of the primary element to the secondary element. Optionally, an arrow holder can be oriented on the supporting structures at a location opposite the quiver hood, generally below the mounting system.

In yet another embodiment, the secondary element can be slidable or otherwise moveable along the supporting structures to adjust the vertical or other spatial orientation of the supporting structures, quiver, or one or more arrow holders to provide a desired spatial orientation of the quiver components relative to the archery bow or arrows held with the quiver, depending on the application.

In even a further embodiment, at least one of the primary element and secondary element can include an interfacing surface that is disposed between these elements. The interfacing surface can be in the form of an elastomeric, rubber, silicone or polymeric layer that is over-molded over at least a portion of the primary element and/or the secondary element. This interfacing element can generally isolate the quiver from vibrations generated from the bow to which the quiver is attached when the bow is shot. It also can reduce the potential for noise generated via the primary and secondary elements moving or vibrating relative to one another. Optionally, the interfacing element can enhance the retention capability and the engagement between the primary element and the secondary element.

The mounting system described herein provides a simple and efficient mechanism to attach one object to another. Where the mounting system is used to mount a quiver to an archery bow or other archery accessory, the quiver is easily coupled and decoupled relative to the mounted object. Further, where the primary element and secondary element include an elastomeric or other vibration dampening structure therebetween, the quiver can be isolated from vibrations incidental to the shooting of the bow.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
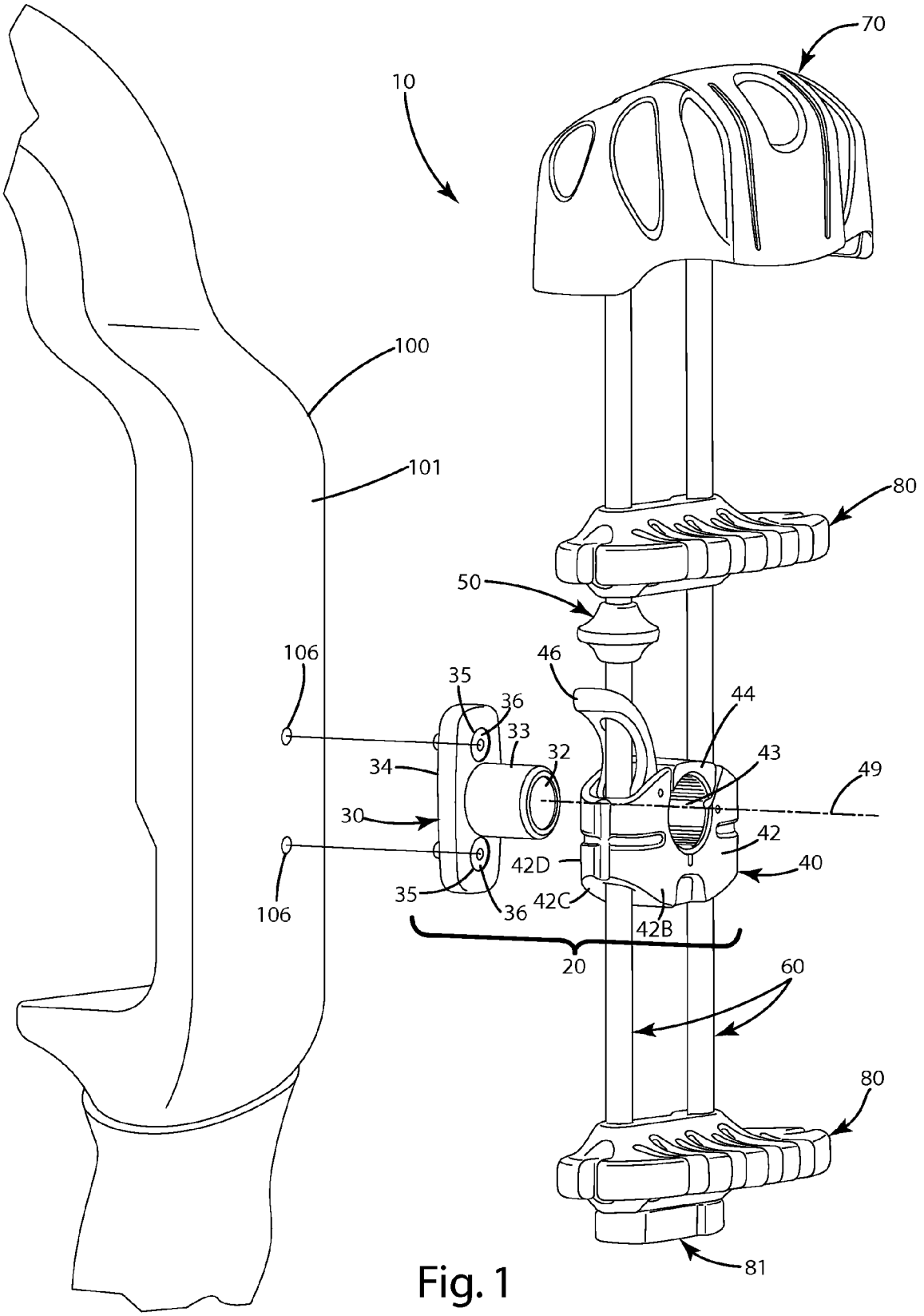
FIG. 1 is a perspective view of a current embodiment of the mounting system shown in connection with a quiver for use with an archery bow, where a primary element and secondary element of the mounting system are about to engage one another.

A current embodiment of the mounting system is illustrated in FIGS. 1-7 and generally designated 10. The mounting system 20 generally includes a primary element 30 and a secondary element 40. An optional secondary locking member 50 can be in close proximity to a portion of the secondary element 40. The secondary element also can be joined with supporting structures 60, which are generally shown or in the form of rods or bars extending above and below the mounting system 20. To the supporting structures 60, a hood 70 can be joined distal from the mounting system 20. One or more arrow holders 80 can be joined to the supporting structures 60 as shown as well.

Although shown in conjunction with a quiver mounted to an archery bow 100, and more particularly to an archery bow riser 101, the mounting system 20 can be used to mount the quiver, or any other items attached to the mounting system, directly to a variety of archery or hunting items, for example, a harness, a belt, a tree stand, a ground blind, a vehicle, or other accessory used in connection with hunting or archery. Of course, if desired, the mounting system can be used to mount virtually any object to another object, and can be modified for the particular application.

Figure 2:
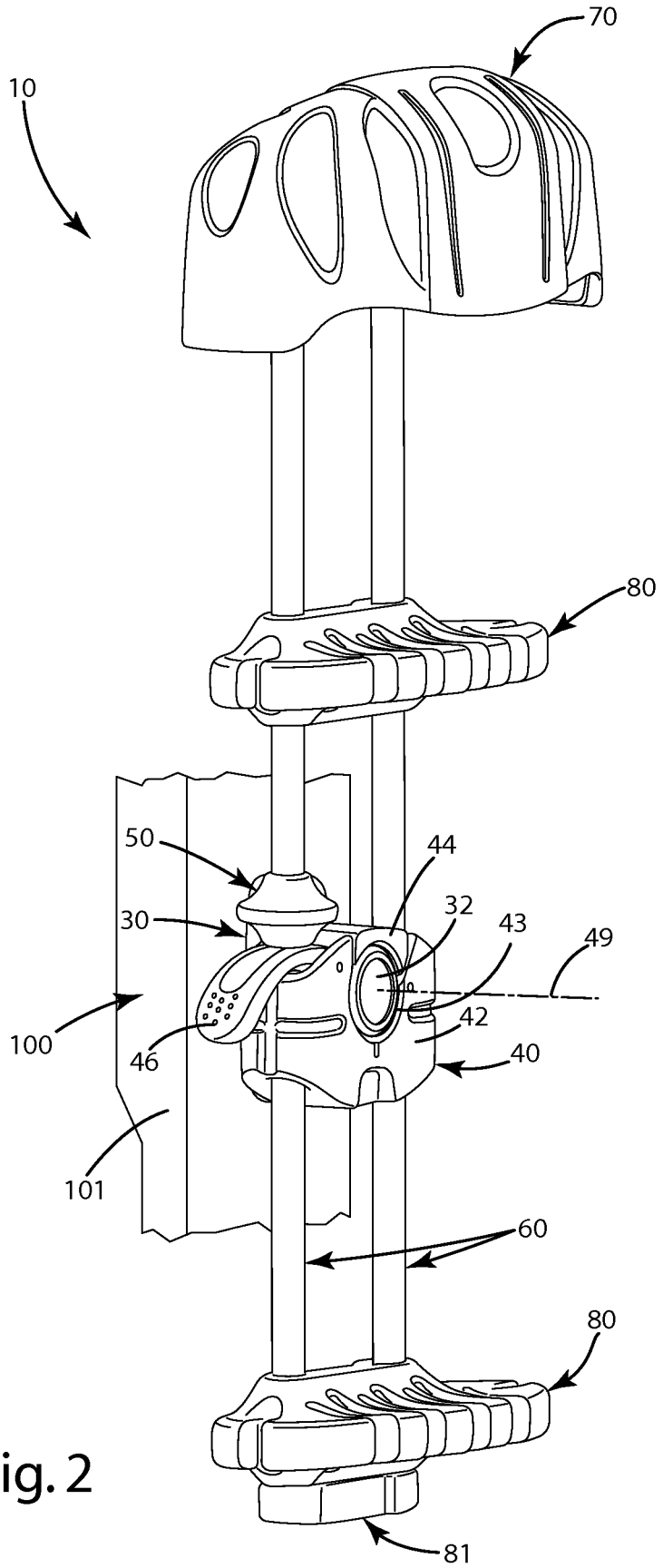
FIG. 2 is a perspective view of the mounting system with the primary element engaged by the secondary element of the mounting system to lock the elements in a fixed spatial configuration relative to one another.

Referring to FIGS. 1 and 2, the mounting system 20 includes a primary element 30 and a secondary element 40. The primary element 30 can include a base 34 from which a projection 32 extends. The projection 32 can be in the form of a cylindrical element, but could be of a variety of other geometric shapes such as square, hexagonal, pentagonal, octagonal, or other shapes. The primary element 30 optionally can be tapered from the base toward the free end of the projection, opposite the base, so that the cross section of the projection decreases in that direction. The base 34 optionally can be a relatively planar plate-like element that is formed to define first and second holes 35. These holes 35 can accommodate fasteners 36 which can be in the form of screws that directly attach the base 34 to another object.

With reference to FIG. 1, the projection 32 optionally can be configured so that it projects outward and away from the riser 101 when attached to the bow 100. Further optionally, the projection 32 can be configured to project generally orthogonally away from the side of the riser 101.

As shown in FIG. 1, the fasteners 36 can be configured to align with, and can fit into holes 106 defined by a riser of a bow 100. If desired, the fasteners and holes can be threaded to mate with one another. Of course, the fasteners can mount directly to other objects as described herein. Optionally, the base 34 can be deleted entirely and the projection 32 can include its own separate or integral fastener, connector, or stud to join the projection 32 directly with the riser of the bow 100. Such a fastener, connector or stud can screw directly into one or more of the holes 106 defined in the riser 101 of the bow 100.

As shown in FIG. 1, the base 34 of the primary element 30 can be joined directly with the projection 32. The base and projection can be of a single-piece integral construction and can be molded together, or otherwise can be joined with one another. Where the primary element 30 is of a single piece integral construction, it can be molded from a plastic, rubber, metal, or composite material sufficiently rigid to adequately support the weight of a quiver or other object to which the mounting system is attached. Optionally, the entire primary element, including the projection and base where included, can be molded from a piece of rubber or a similar elastomeric material that can absorb vibration and/or isolate vibration transferred from the bow to the quiver.

Alternatively, the projection 32 and the base 34 can be separate pieces that are secured together with fasteners and/or adhesives. Where the primary element 30 is of a two piece non-integral design, the projection 32 can be joined with the base 34 in a variety of manners. For example, the projection 32 can be attached to the base via screws or other fasteners. Optionally, the base 34 can define a threaded bore that engages a corresponding external thread on a portion of a periphery of the projection 32, or the components may be joined together by gluing, welding, or fusion.

Regardless of whether a single piece integral construction or a two-piece construction is used, the primary element can be constructed with the outer surfaces of the projection 32, and optionally the base 34, modified to provide a degree of noise suppression between the primary element 30 and the secondary element 40 of the mounting system, and/or to increase the retention capability and engagement between these elements, and/or to isolate vibrations generated from the bow 100, generally impairing them from being passed substantially to the quiver 70 and arrows held therein. For example, the outer surface of the projection 32 can be coated, covered, or otherwise provided with a resilient elastomeric interfacing element 33. This elastomeric interfacing element 33 can be constructed from materials such as elastomers, rubber, silicone, low density plastics, and/or other materials. The material can be over-molded over the projection 32 and/or the base 34. Alternatively, the material can be painted, brushed, or dipped on or otherwise applied to one or more surfaces of the projection 32, generally forming a layer of the material over the projection, optionally in regions where the primary element and secondary element engage one another.

Generally, when the projection 32 is trapped or otherwise engaged by the secondary element 40, the optional interfacing element 33 is disposed between the projection 32 and the surfaces of the secondary element 40. The interfacing element 33 can generally reduce the potential for noise when engaging the secondary element 40 of the mounting system 20 with the primary element 30. The interfacing element also can provide a better positional retention of the secondary element 40 relative to the primary element 30 (that is, it can provide a better grip), and a certain degree of vibration isolation between the quiver 10 and the bow 100.

The primary element 30, and more particularly, the projection 32 and the optional interfacing element 33, are configured to be inserted into an aperture 43 defined by the secondary element 40. The secondary element 40 can include a base 42 that defines at least a portion of the aperture 43. In addition, the secondary element 40 can include an engagement member 44 that is configured to selectively engage the primary element 30, and more particularly the projection 32 and/or the interfacing element 33 when the same are placed at least partially within the aperture 43 defined by the secondary element. The secondary element also can include an actuator 46 that is configured to engage and move the engagement member 44 so that the engagement member 44 exerts a force on the projection 32, or more generally on the primary element 30, to lockingly secure the secondary element 40 in a fixed spatial relation relative to the primary element 30. For example, the engagement member and/or actuator can lock the primary element and secondary element in place relative to one another so that these elements cannot slide relative to one another nor rotate relative to one another.

As shown in FIGS. 1 and 2, the aperture 43 of the secondary element 40 is defined at least partially by the engagement member 44 and the base 42 of the secondary element. The portions of these components, that is, the engagement member 44 and the base 42 forming the periphery of the aperture 43, can be of a geometric configuration that generally matches that of the projection 32 and any optional interfacing element 33. These components, at the periphery of the aperture 43 can also include serrations, projections, and/or knurlings, or can include a generally rough surface so as to better engage the projection 32 of the primary element 30 when the secondary element 40 is in a closed mode.

Optionally, the 42 base and its components can be configured so that it forms about 50% or more of more of the periphery of the aperture 43. The engagement member 44 and its components can be configured so that it forms less than about 50% of the periphery of the aperture 43. The amounts by which the respective base and engagement member form the periphery can be reversed or modified depending on the type and shape of the projection used in a particular application.

Figure 3:
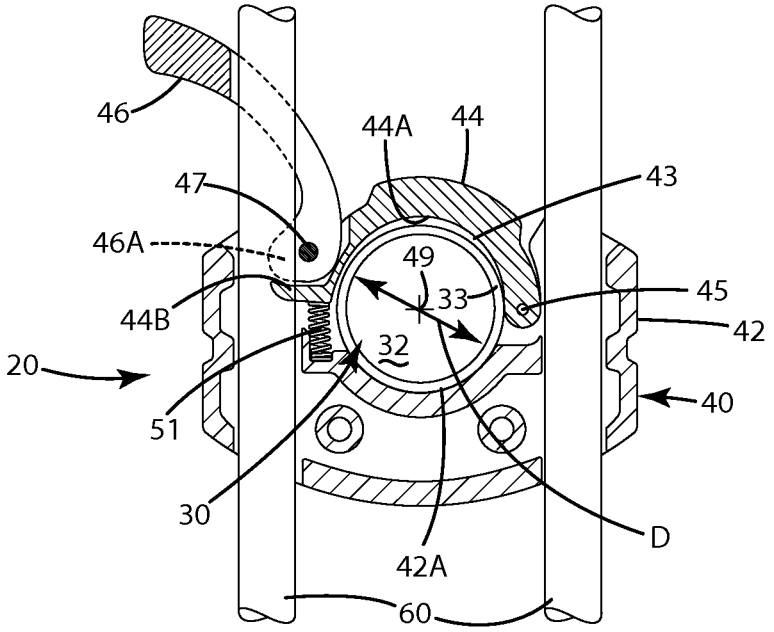
FIG. 3 is a front sectional view of the mounting system with the secondary element in an open mode.
Figure 4:
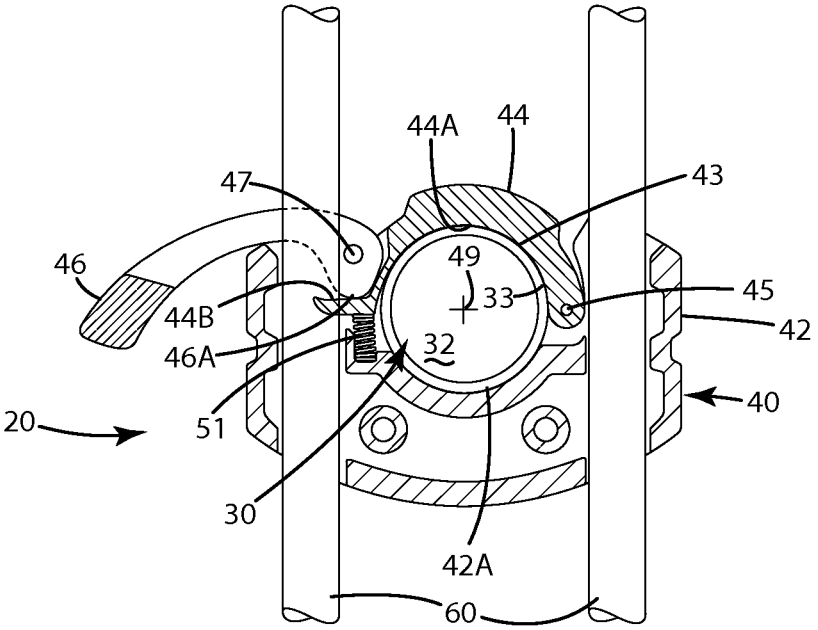
FIG. 4 is another front sectional view of the mounting system with the secondary element in a closed mode and engaging the primary element.

As shown in FIGS. 3 and 4, the engagement member 44 can be pivotally joined with the base 42 via an engagement member pivot pin 45 or other structure. Generally, the engagement member 44 is moveable between a first position and a second position. In the first position, the engagement member is generally moved away from the longitudinal axis 49, optionally generally radially away from the longitudinal axis, to open up the aperture and provide sufficient room for the projection to be slidingly inserted into the aperture. In the second position, the engagement member is configured so that the interior surface 44A of the engagement member 44 engages the primary element 30, and more particularly the projection 32, and optionally the interfacing element 33. The engagement member pivot pin 45 can be in the form of a roll pin, fastener or other suitable rod or element joined with or extending through at least a portion of the base 42.

As shown in FIGS. 3-4, the actuator 46 can be in the form of a lever that is positioned with a camming lobe or end 46A immediately adjacent an engagement end 44B of the engagement member 44. The engagement end 44B of the engagement member can be in the form of a planar plate or element which is positioned immediately adjacent the camming lobe 46A. Optionally, the planar plate can be modified to include a rounded or curved portion to alter the responsiveness of the engagement between the lobe 46A and the end 44B.

As shown in FIGS. 3 and 4, the actuator 46 can be joined to the base 42 with an actuator pin 47. When the lever 46 is moved or generally rotated about the actuator pin 47, its camming end 46A engages the end 44B of the engagement member 44 so as to operably move the engagement member from the orientation shown in FIG. 3 to the orientation shown in FIG. 4. In so doing, the actuator 46 transitions the engagement member 44, and generally the mounting system 20, from an open mode, shown in FIG. 3, to the closed mode in FIG. 4.

In the open mode, shown in FIG. 3, the engagement member does not, or only minimally, engages the projection 32 of the primary member 30. In the closed mode, shown in FIG. 4, the actuator 46 has moved the engagement member 44 into close proximity with the periphery of the projection 32 of the primary element 30. In turn, the secondary element 40 and more particularly the interior surfaces 44A of the engagement member 44 and the interior surface 42A of the base, which form a portion of the aperture 43, clampingly engage the projection 32 of the primary element 30 around at least a portion of the outer circumference or periphery thereof. The amount of engagement can be regulated by the precise geometric configurations of the engagement member 44, the actuator 46, and the interfacing of these elements with one another. If desired, when the actuator 46 is in the form of a lever, the camming end 46A of the lever can be configured so that it attains an over-center position when engaged against the end 44B of the engagement member 44. In turn, this can effectively lock the actuator and engagement member in a fixed position to secure the primary element to the secondary element.

Optionally, the mounting system 20 can include a spring 51 which as shown in FIG. 3, biases the engagement member 44 in the open position shown there so that the projection 32 can fit within the opening 43. When the lever 46 is transitioned to the closed mode shown in FIG. 4, the operation of a lever engages the camming end 46A thereof against the end 44B of the engagement member 44. This in turn opposes the spring 51, urging the spring 51 to compress as shown in FIG. 4. Of course the spring, as illustrated, can be substituted with other mechanisms which can hold or urge the engagement member or lever in open or closed modes depending on the particular desired action of the mounting system 20. For example, the illustrated coil spring could be in the form of an elastomeric element, or a leaf spring oriented to urge the engagement member open or closed, depending on the desired operation and configuration.

As noted above, where the projection 32 includes the optional interfacing element 33, this can provide additional gripping action between the base 42, the engagement member 44 and the projection 32. Further, when the engagement member 44, base 42, or other elements generally engage the projection 32, this gripping element can be achieved either directly or indirectly, with or without the interfacing element 33 being positioned between the projection 32 and the elements.

The quiver 10 optionally can include a secondary locking member 50 as illustrated in FIG. 1. The secondary locking member 50 can be coaxially mounted to a supporting structure 60. The secondary locking member 50 can be constructed from a resilient or elastomeric material that can be snuggly fit on the supporting structure so that, with manual force, the secondary locking member can be slid along the supporting structure. Generally, the secondary locking member can be in the form of a washer that is fit on one or more of the supporting structures 60.

As shown in FIG. 1, when it is desired to have the actuator 46 disengage the engagement member 44 so that the secondary element 40 is generally in an open mode, the secondary locking member 50 can be slid upward to enable the actuator 46 to open the secondary element 40. When it is desired to lock the actuator 46 in a preselected position, the secondary locking member 50 can be slid downwardly along the supporting structure 60 to engage and contact the lever 46, thereby holding it in the down position as shown in FIG. 4 so that the secondary element 40 is retained in a closed mode. Of course, other secondary locking members or features can be incorporated into the mounting system 20 to further ensure that the secondary element 40 remains engaged with the primary element 30 to hold these components in a fixed spatial orientation relative to one another.

The various components of the primary element 30 and the secondary element 40 can be constructed from plastic, metal, and/or composite materials of the desired colors and patterns. Any or all of the components of the quiver can be die cast or otherwise formed from a suitable metal or alloy such as aluminum or magnesium. And of course, the various components can be camouflaged or otherwise have their surfaces treated or coated with a suitable material for a desired functional, tactile or aesthetic effect.

If desired, the secondary element 40 can be of a modular or multi-piece construction. For example, the base 42 can include first 42C and second 42B halves to facilitate its assembly and joining with the supporting structures 60. These halves can be defined by a vertical plane that generally passes through or near the center lines of the supporting structure 60. Screws or other fasteners can fasten the first and second halves to one another, and likewise sandwich the respective supporting structures 60 within the base. In addition, the actuator pin 47 and engagement member pin 45 can be replaced with fasteners or can otherwise secure the halves to one another. Of course, the base 42 can be separated into different portions or constructed from a single monolithic structure with the respective engagement member 44 and actuator 46 joined therewith. The supporting structures 60 can be inserted through respective vertical bores (not shown), generally perpendicular to the aperture 43 which accommodates the primary element 30 and/or the longitudinal axis 49.

Further optionally, the secondary element 40 can be in the form of a band (not shown) configured to circumferentiate the projection of the primary element 30. The band can be connected to the base and/or connected directly to the supporting structures. The ends of the band can be connected with a fastener, for example a bolt. By tightening the fastener, the ends of the band or other portions of the band are drawn nearer one another so that an interior surface of the band clampingly engages the projection, generally about an outer periphery of the projection.

As shown in FIGS. 1 and 2, the supporting structures 60 can generally extend from the mounting system 20 toward the quiver hood 70. The supporting structures 60 can be in the form of rods, bars, or struts. These structures can be positioned generally vertically when the quiver is held upright, and can extend above and below the mounting system 20. Above the mounting system 20, the supporting structures 60 support the quiver and an optional arrow holder 80. Below the mounting system 20, the supporting structures can further extend and can support yet another arrow holder 80 if desired. The ends of the supporting structures can be joined via an end bracket 81 which is described in further detail below.

While the supporting structures are shown as two parallel cylindrical rods, the cross section of these supporting structures can be other than circular, for example they can be square, rectangular, hexagonal, octagonal, or virtually any other geometric shape. The rods can be of any length or cross section, and can be of any desired number, depending on the particular application. The supporting structures 60 also can be constructed from a variety of materials including but not limited to aluminum, graphite, fiberglass, composite, or other materials in either rod or tubular form.

Optionally, the supporting structures 60 can be secured to a bracket (not shown) that joins the end bracket 81 as well as the bracket portions 83 of the respective arrow holders 80. These components can be constructed from relatively semi-rigid or rigid materials including but not limited to molded plastics and/or rigid or thickened elastomeric material. The respective brackets can be provided within identically spaced and sized openings to properly position the components relative to the supporting structure 60 in a desired manner.

Figure 5:
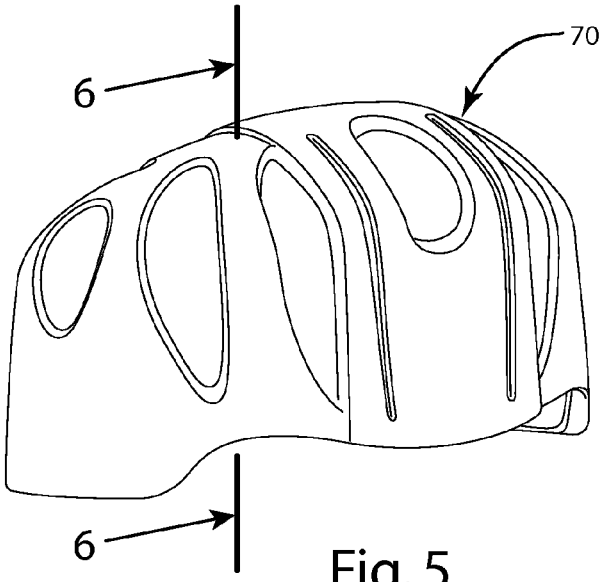
FIG. 5 is a close-up perspective view of a hood of the quiver.
Figure 6:
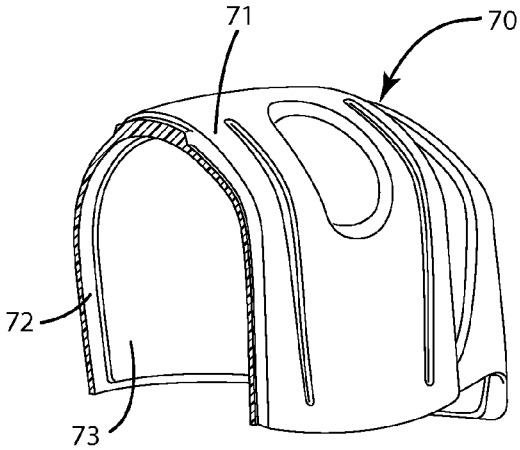
FIG. 6 is a section view of the quiver taken along line 6-6 of FIG. 5.

As shown in FIGS. 5 and 6, the quiver 10 can include a hood 70. The hood can include an outer housing 71. The outer housing 71 can be constructed from a rigid plastic material or metal, and can be decorated with the appropriate camouflage, pattern or decorative surface. Alternatively, for weight savings and/or noise attenuation, the outer housing can be constructed from a soft foam material, which can be covered with a decorative outer fabric layer (not shown). This outer fabric layer can have a camouflage or other appearance.

As illustrated in the embodiment of FIGS. 5 and 6, the outer housing 71 can be joined with an internal foam liner 72. This internal foam liner can be molded together with the outer rigid housing. For example, the outer housing of the quiver hood 70 can be bonded directly to the inner foam liner in a molding process. With this internal foam liner, if the hood is bumped, the inner foam liner will reduce the effect of shocks to the exterior housing and absorb sound. Another semi-rigid internal backer 73 can be positioned adjacent the internal foam liner 72 so that the internal foam liner 72 generally is sandwiched between the outer housing and the inner housing. This backer or inner housing can be of a semi-rigid construction, and can likewise be formed from plastic, rubber, composites or metal. It can further be constructed to snap fit into position over at least a portion of the inner foam liner 72 to protect that liner from the tips of arrows and broadheads to prevent them from slicing or damaging the foam liner. If desired, the backer or inner housing 73 can be subdivided into separate compartments and adapted to isolate individual broadheads or arrow tips from one another. Although not shown, a bracket can be joined directly with the inner and/or outer housings to secure the hood 70 directly to the supporting structures 60.

Figure 7:
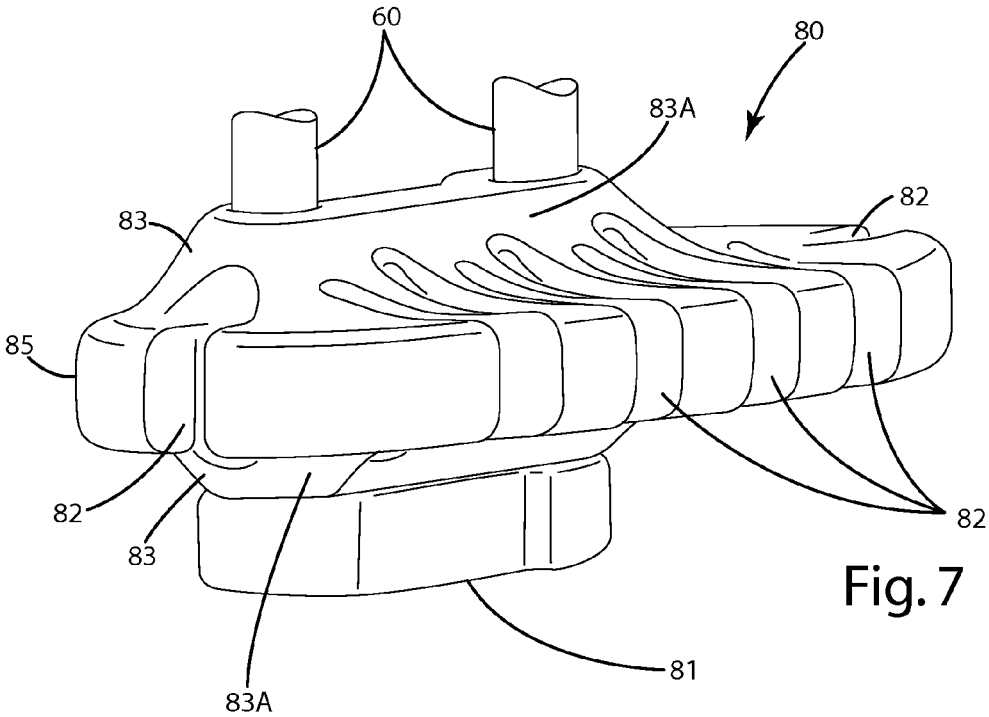
FIG. 7 is a close-up view of an arrow holder of the quiver.

FIG. 7 illustrates an arrow holder 80 that can be used in the current embodiment, however, other arrow holders may be substituted for that arrow holder depending on the application. One or more arrow holders can be included on the quiver depending on the particular application. The arrow holder 80 can define multiple slots 82 configured to receive and retain arrows. The arrow holder 80 can include upper and lower filleted sections 83A that transition generally from the arrow holding portion of the arrow holder 80 to a bracket portion 83. The bracket portion 83 can be slidably positioned on the supporting structures 60 to adjust the position of the arrow holder 80 relative to the mounting system 20 and/or bow 100 in conformance with an archer's desired positioning. Optionally, the bracket portion 83 can be configured so that it fixedly secures the arrow holder 80 in a pre-selected location along the support structures 60.

As also shown in FIG. 7, the quiver can be outfitted with an end bracket 81 that secures the ends of the supporting structures 60 in a fixed orientation relative to one another. As shown, it generally holds the supporting structures 60 parallel to one another. The end bracket 81 can be secured to the supporting structure 60 via adhesives or fasteners. Of course, where the arrow holders 80 are sufficient rigidity to hold the supporting structure 60 in a desired orientation, the end bracket 81 can be absent from the quiver. Further, the arrow holder 80 and end bracket 81 can be separate components if desired as well.

The arrow holder 80 can be constructed from an elastomeric or other material with sufficient flexibility to retain the arrows yet enable the arrows to be inserted and removed therefrom with relative ease and minimal noise. If desired, and as shown in FIG. 7, the flatter arrow holding portion 85 that defines the respective arrow slots or grooves 82 can transition to the bracket portion 83. At this transition, the arrow holder 80 can include fillets or rounded or radiused sections 83A to provide overall rigidity to the arrow holder 80, without impacting the ease of insertion and removal of the arrows from the arrow slots 82 defined in the arrow holding portion 85.

Referring to FIGS. 1-4, operation of the quiver, and in particular, the mounting system 20, will now be described. Generally, the engagement member 44, and in particular the internal surface 44A is initially spaced a distance from the base internal surface 42A so that the projection 32 can be positioned within the aperture 43. Where the projection 32 is generally of a cylindrical construction, the interior surface 44A can be spaced a distance that is greater than the diameter D of the projection 32. The projection 32 can be moved generally coaxially, along the longitudinal axis 49 of the aperture, passing through a mounting plane that generally is defined by the rearward surface 42D of the base 42 which generally faces directly toward the riser upon installation of the quiver. Generally, the projection moves so that it passes orthogonally through the mounting plane of the secondary element. Optionally, the projection 32 is slidingly inserted into the aperture 43 moving parallel to the longitudinal axis 49 of the aperture.

The projection 32, in turn, is placed within the aperture 43 as shown in FIGS. 2 and 3. The rearward surface 42D of the base 42 can engage the base 34 to provide tactile feedback to the archer that the projection 32 is fully inserted in the aperture 43. The archer then may rotate the secondary element 40 about the longitudinal axis 49 of the aperture 43 to achieve a desired rotational disposition of the quiver 10, the supporting structures, and/or the hood relative to the bow 100. After this position is achieved, the archer moves the actuator 46 so that it rotates about the lever pin 47. In turn, the end 46A of the actuator 46 engages the engagement member end 44B. This, in turn, moves the engagement member 44 toward, or in more forceful engagement with, the projection 32 of the primary element 30. Generally, the engagement element 44 can rotate during this movement about the engagement member pin 45. In so doing, the engagement member and its interior surface 44A moves toward the longitudinal axis 49 of the aperture 43, and generally closes or reduces the dimensions of the aperture 43 until the engagement member and/or base clampingly engages the projection 32 and any optional interfacing element 33 associated therewith. Optionally, the engagement member and its interior surface 44A can move generally radially inward, toward the longitudinal axis.

The movement of the actuator 46 continues until the engagement member 44, interior surface 44A and the base 42 satisfactorily clampingly engage and/or lock the projection 32 within the aperture so that the secondary element 40 generally is not rotatable, is not slidable, and/or is immovable relative to the projection 32 of the primary element 30. The movement of the actuator 46 can be countered slightly by the compression of the spring 51. As noted above, to lock the actuator 46, when in the form of a lever as shown in FIGS. 1 and 2, the optional secondary locking member 50 can be slid downwardly to the position shown in FIG. 2. Of course, if desired, the lever 46 can be outfitted with a spring (not shown) to assist in biasing it to the closed position shown in FIGS. 2 and 4.

FIG. 4 illustrates the configuration of the components of the secondary element 40 clampingly engaging the projection 32 and any optional interfacing element 33 of the primary element 30. Where optional serrations or teeth are included in the periphery of the aperture 43, those elements can engage the interfacing member 33, which again optionally can be constructed from a resilient material to enhance the retention and improve the locking of the primary and secondary elements relative to one another.

To remove the quiver 10 from the bow 100, the archer deactivates the mounting system 20, and releases the primary element 30 from the secondary element 40. To do so, the archer moves the actuator 46 in the opposite direction described above, which in turn enables the engagement member 44 to disengage the projection 32, or at least reduce the amount of force exerted by the engagement member 44, so that the parts can be separated and the quiver dismounted from the archery bow 100.

A first alternative embodiment, not shown, of the quiver is contemplated. Generally, this embodiment is similar to the above embodiment with several exceptions. For example, the secondary element, supporting structures and arrow retainers can be modified. Specifically, the rods of the current embodiment can be replaced with a flat strut as the major structural component. While the cross-sectional shape of the flat strut can be generally rectangular, this does not preclude the use of other cross-sectional shapes that may readily serve the intended structural function. The strut can be manufactured from steel, aluminum, or other suitable metal alloys, or from a composite material such as, but not limited to, a graphite or fiberglass composite.

The strut component can be provided with an elongated slot along a vertical centerline. The secondary element of the mounting system can be positioned generally in and adjacent to the slot, centering it laterally while providing a significant degree of vertical adjustment to accommodate a variety of mounting locations on the bow.

In this embodiment, the secondary element can utilize a split base that encompasses the opposing portions of the strut that extend beyond its central slot. While the configuration of the arrow retainers is similar to those of the current embodiment, a modification includes retainers that are provided with elongated openings for the unitary strut, instead of separate openings for the two supporting structures of the current embodiment.

A second alternative embodiment, not shown, of the quiver is also contemplated. In this embodiment, the primary element can be configured to expand within an aperture defined by the secondary element. For example, the primary element can include a first end having a stud or a bracket that attaches the primary element to a riser or archery accessory. The primary element can include a second end distal from the first end, and a middle portion therebetween. The primary element can include an engagement member in the form of a plunger so that movement of the second end toward the first end bulges out the middle portion and/or the second and first ends to increase the cross section of the primary element. Optionally, the primary element is cylindrical, but when activated, the middle region of the cylinder bulges outward to increase the diameter in the middle portion, generally operating to clampingly engage the aperture with the primary element. Further optionally, the plunger can include locking mechanism so the primary element retains its bulged or expanded configuration.

In this embodiment, the secondary element can include an aperture into which the primary element is inserted, generally orthogonally, through a back or rear surface of the secondary element, similar to the embodiments above. When the primary element is satisfactorily inserted into the aperture, a user can actuate the engagement member or plunger, moving the second end toward the first end to expand the dimensions of the primary element within the aperture. The primary element thereby bulges out to forcibly engage the inner dimensions/diameter of the aperture, thereby locking the primary element in engagement with the secondary element. Where a locking mechanism is included, it may be actuated to lock the primary component in the bulged configuration.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A archery quiver for attachment to an archery bow comprising:

a primary element including a projection adapted to extend outwardly and away from a riser of an archery bow, the primary element including an interfacing portion and an outer end;

a secondary element including a base at least partially defining an aperture, the aperture having a longitudinal axis, the secondary element further defining a mounting plane, the primary element configured for insertion into the aperture along the longitudinal axis generally orthogonal to the mounting plane;

a lever and an engagement member joined with the secondary element, the lever configured to move the engagement member so that the engagement member clampingly engages the primary element when the primary element is substantially inserted in the aperture to join the primary element and secondary element in a fixed spatial orientation relative to one another;

a supporting structure joined with the secondary element;

a quiver hood joined with the supporting structure, the quiver hood configured to house at least one of a field point and a broadhead associated with an arrow held by the quiver; and an arrow holder joined with the supporting structure, the arrow holder being distal from the quiver hood, wherein the base of the secondary element includes a rearward surface and an outer surface opposite the rearward surface, the rearward surface facing the riser of the bow, the outer surface being generally flush with the outer end when the primary element is fully inserted in the aperture.

2. The archery quiver of claim 1 wherein the interfacing portion is constructed from an elastomeric material that isolates the secondary element from vibration generated by the bow when the bow is shot.

3. The archery quiver of claim 1, wherein the lever includes a cam lobe, and wherein the engagement member includes an end positioned adjacent the cam lobe for engagement by the cam lobe to move the engagement member.

4. The archery quiver of claim 1, wherein the base defines more than 50% of the aperture, and wherein the engagement member defines less than 50% of the aperture.

5. The archery quiver of claim 1, wherein the projection is of a substantially cylindrical shape, and wherein the base defines an interior surface that corresponds to and mates with the cylindrical shape of the projection when the projection is inserted in the aperture.

6. An archery quiver for attachment to an archery bow comprising:

a primary element including a projection adapted to extend outwardly and away from a riser of an archery bow, the primary element including an interfacing portion;

a secondary element including a base at least partially defining an aperture, the aperture having a longitudinal axis, the secondary element further defining a mounting plane, the primary element configured for insertion into the aperture along the longitudinal axis generally orthogonal to the mounting plane;

a lever and an engagement member joined with the secondary element, the lever configured to move the engagement member so that the engagement member clampingly engages the primary element when the primary element is substantially inserted in the aperture to join the primary element and secondary element in a fixed spatial orientation relative to one another;

a supporting structure joined with the secondary element;

a quiver hood joined with the supporting structure, the quiver hood configured to house at least one of a field point and a broadhead associated with an arrow held by the quiver; and an arrow holder joined with the supporting structure, the arrow holder being distal from the quiver hood, wherein the base defines another aperture that is generally perpendicular to and offset from the longitudinal axis, wherein the supporting structure is positioned through the other aperture.

7. An archery quiver for attachment to an archery bow comprising:

a primary element including a projection adapted to extend generally outward and away from a riser of an archery bow;

a secondary element defining an aperture, the aperture including a longitudinal axis and defining a periphery, the secondary element including a rear surface configured to face directly toward the riser, the rear surface defining a mounting plane adjacent the aperture, the secondary element configured so that the primary element is insertable into the aperture aligned with the longitudinal axis, and generally orthogonal to the mounting plane;

an engagement member adjacent the aperture and configured to clampingly join the primary element and secondary element in a fixed, non-rotating and non-sliding spatial relationship relative to one another when the primary element is inserted in the aperture;

a supporting structure joined with the secondary element; and a quiver hood joined with the supporting structure distal from the secondary element, wherein the engagement member forms less than 50% of the periphery of the aperture.

8. The archery quiver of claim 7 comprising an arrow holder joined with the supporting structure, wherein the quiver hood is located above the secondary element, and wherein the arrow holder is located below the secondary element.

9. The archery quiver of claim 7 wherein the projection includes an interfacing portion configured to be disposed between the projection and the engagement member, the interfacing portion being constructed from an elastomeric material to isolate the secondary element from vibration generated in the bow.

10. The archery quiver of claim 7 comprising an actuator adjacent the engagement member, the actuator configured to cam against the engagement member to move the engagement member between an open mode and a closed mode.

11. The archery quiver of claim 10 wherein the actuator is manually operable by a user without the use of tools, to convert the engagement member from the open mode to the closed mode.

12. The archery quiver of claim 7 comprising an actuator rotatably mounted to the secondary element, the actuator including an end that selectively moves the engagement member generally radially toward the longitudinal axis of the aperture to engage the engagement member against the projection.

13. The archery quiver of claim 7, wherein the secondary member includes a base, wherein the base defines a first portion of the aperture, wherein the engagement member defines a second portion of the aperture, and wherein the engagement member is moveable toward the longitudinal axis of the aperture.

14. The archery quiver of claim 13 comprising an actuator including a camming lobe positioned adjacent an end of the engagement member.

15. The archery quiver of claim 7, wherein the secondary member includes a base, wherein the base includes an actuator, the actuator being manually moveable without tools to actuate the engagement member from an open mode to a closed mode.

16. An archery quiver for attachment to an archery bow comprising:

a primary element including a projection adapted to extend generally outward and away from a riser of an archery bow, the primary element including an outer end;

a secondary element defining an aperture, the aperture including a longitudinal axis, the secondary element including a rear surface configured to face directly toward the riser, the rear surface defining a mounting plane adjacent the aperture, the secondary element configured so that the primary element is insertable into the aperture aligned with the longitudinal axis, and generally orthogonal to the mounting plane, the secondary element including an outer surface, wherein the outer end is generally flush with the outer surface when the primary element is fully inserted in the aperture;

an engagement member adjacent the aperture and configured to clampingly join the primary element and secondary element in a fixed, non-rotating and non-sliding spatial relationship relative to one another when the primary element is inserted in the aperture;

a supporting structure joined with the secondary element; and a quiver hood joined with the supporting structure distal from the secondary element.

17. An archery quiver for attachment to an archery bow comprising:

a primary element including a projection adapted to extend generally outward and away from a riser of an archery bow;

a secondary element defining an aperture, the aperture including a longitudinal axis, the secondary element including a rear surface configured to face directly toward the riser, the rear surface defining a mounting plane adjacent the aperture, the secondary element configured so that the primary element is insertable into the aperture aligned with the longitudinal axis, and generally orthogonal to the mounting plane;

an engagement member adjacent the aperture and configured to clampingly join the primary element and secondary element in a fixed, non-rotating and non-sliding spatial relationship relative to one another when the primary element is inserted in the aperture;

a supporting structure joined with the secondary element;

a quiver hood joined with the supporting structure distal from the secondary element; and a secondary locking element slidingly mounted on the supporting structure.

18. A method of mounting an archery quiver to an archery bow comprising:

providing a projection extending outward and away from an archery bow;

providing a secondary element defining an aperture having a longitudinal axis, the secondary element including a rear surface defining a mounting plane adjacent the aperture, the secondary element including an engagement member adjacent the aperture;

inserting the projection into the aperture along a path aligned with the longitudinal axis so that the projection is orthogonal to the mounting plane;

rotating the secondary element to selectively position at least one of a supporting structure and a quiver hood relative to the archery bow; and engaging the engagement member when the primary element is inserted in the aperture so that the engagement member rotates about a pivot pin and moves toward the longitudinal axis to clampingly join the primary element and secondary element in a fixed, non-rotating and non-sliding relationship spatial relative to one another.

19. The method of claim 18, wherein the secondary element includes a lever, comprising rotating the lever to engage the engagement member against the projection.

20. The method of claim 18 comprising attaching the projection to the archery bow with a fastener so that the projection extends generally orthogonally away from a riser of the archery bow.

* * * * *